United States Patent [19]

Martin et al.

[11] Patent Number: 4,774,541

[45] Date of Patent: Sep. 27, 1988

[54] SINGLE COMPONENT DEVELOPMENT SYSTEM WITH BIASED SQUIRREL CAGE FOR DELIVERING TONER PARTICLES TO A CHARGING NIP

[75] Inventors: Robert G. Martin, Rochester; Raymond W. Stover, Webster; Michael G. Swales, Joy,Sodus, all of N.Y.

[73] Assignee: Xerox Corporation, Stamford, Conn.

[21] Appl. No.: 932,831

[22] Filed: Nov. 20, 1986

[51] Int. Cl.[4] ..... G03G 15/08

[52] U.S. Cl. ..... 355/3 DD; 118/653; 355/77

[58] Field of Search ..... 355/3 DD, 77; 118/653, 118/656; 430/120, 123

[56] References Cited

U.S. PATENT DOCUMENTS

| | | | |
|---|---|---|---|
| 3,687,106 | 8/1972 | Stange | 118/621 |
| 3,870,017 | 3/1975 | Kratcoski et al. | 355/3 DD |
| 3,900,002 | 8/1975 | Stange | 118/637 |
| 4,330,193 | 5/1982 | Stange | 355/3 DD |
| 4,352,552 | 10/1982 | Stange | 355/4 |
| 4,480,905 | 11/1984 | Yoshino | 355/3 DD |
| 4,481,903 | 11/1984 | Huberhauer et al. | 118/653 |

FOREIGN PATENT DOCUMENTS

| | | | |
|---|---|---|---|
| 2429020 | 1/1975 | Fed. Rep. of Germany . | |
| 80876 | 5/1985 | Japan | 355/3 DD |
| 207166 | 10/1985 | Japan | 355/3 DD |
| 443915 | 2/1968 | Switzerland | 355/3 DD |

*Primary Examiner*—William H. Beha, Jr.
*Attorney, Agent, or Firm*—E. O. Palazzo

[57] ABSTRACT

An apparatus for charging insulating toner particles which comprises a charging roll, a transporting roll or donor belt, and a squirrel cage toner delivery device. A charging nip is situated between the charging roll and the transporting roll or donor belt, and the transporting roll or donor belt and the charging roll are charged to a predetermined potential. The rotating biased wire device in the form of a squirrel cage delivers toner particles from the toner housing to the charging nip. Subsequent to charging, the toner particles are delivered by the transporting roll or donor belt to the photoreceptor.

23 Claims, 1 Drawing Sheet

SINGLE COMPONENT DEVELOPMENT SYSTEM WITH BIASED SQUIRREL CAGE FOR DELIVERING TONER PARTICLES TO A CHARGING NIP

BACKGROUND OF THE INVENTION

This invention is generally directed to a unique development system, and more specifically, the present invention is directed to an improved apparatus for charging and transporting toner particles to a charging zone situated between a metering/charging means such as a metering charging roll and a transporting means. In one embodiment, the present invention is directed to an apparatus and process for simultaneously metering and charging insulating toner particles to a positive or negative polarity by delivering these particles with a biased rotating wire cage, or a known squirrel cage apparatus into rubbing contact with a metering/charging means, such as a metering charging roll, wherein the toner particles are further charged to either a positive or negative polarity. The squirrel cage device incorporated into the apparatus, and process described hereinafter accomplishes a number of objectives inclusive of, for example, its primary function, that is, for transporting toner particles contained in a reservoir or sump to the metering/charging roll nip present in the apparatus involved. Moreover, the squirrel cage may function in a manner to permit the application of charges to the toner particles contained in the sump in view of the triboelectric relationship between the wires of the brush means and the toner particles.

In addition, with the apparatus of the present invention there is provided a metered uniform amount of toner particles to the charging nip; and further, the apparatus of the present invention enables an environmentally insensitive system substantially free of the matting and toner caking problems associated with known brush development methods.

The development of images by numerous methods, including electrostatographic means is well known. In these systems, toner particles are deposited on an electrostatic latent image contained on an insulating surface such as selenium, using for example, cascade development, magnetic brush development, powder cloud development, touchdown development, and other development systems. Generally in these systems two component developer compositions are selected for development, that is compositions containing toner particles and carrier particles. As it is known that there are a number of disadvantages associated with two component systems, including additional costs and processing equipment, there has been considerable effort directed to designing systems which utilize toner particles only. Generally, these systems allow the elimination of a developer reservoir, a toner dispenser, and a toner concentration control means.

Single component development systems are also known, that is, developer compositions comprised of toner resin particles only. The single component imaging devices currently in use generally consume conductive toner particles whereby imagewise toner deposition onto the imaging member is obtained by induction toner charging. Electrostatic transfer of conductive toner particles to plain paper is, however, usually inefficient as, for example, the charge of the toner particles can be reversed by induction charging with plain conductive paper. Electrophotographic systems using conductive single component toner particles therefor usually require a special overcoated paper to achieve electrostatic transport. Moreover, in single component development systems containing conductive toner particles it is difficult to control undesirable background, and background suppression cannot be achieved as the toner particles are inductively charged, and deposited on the image bearing members, which is not the situation in two component development systems wherein the control of background development is accomplished by an electrostatic force acting on the triboelectrically charged toner particles causing such particles to be directed away from the imaging member.

There is disclosed in U.S. Pat. No. 3,900,002 development systems for developing latent electrostatic images which include a rotating fur brush, the purpose of which is to deliver toner particles to the imaging member. As illustrated in FIG. 1 of this patent, a cylindrical applicator, such as a natural fur brush, is selected for incorporation into the apparatus. A similar disclosure is presented in U.S. Pat. No. 3,929,098 wherein there is selected for electrostatic development a brush contained in a developer sump, which brush transfers toner particles to a donor roll. Particles contained on the donor roll are subsequently provided to the photoreceptor imaging member.

Also, there is disclosed in U.S. Pat. No. 3,638,613 a developer apparatus wherein a transfer or donor roll triboelectrically attracts to its surface toner particles contained in a sump or reservoir. Apparently, the fur brush is used for the purpose of removing toner from the transfer or donor roll and depositing such toner particles upon a charged surface where the image contained thereon is rendered visible.

In addition, there is illustrated in U.S. Pat. No 4,481,903 an apparatus for developing electrostatic latent images wherein there is selected, for example, two brushes which rotate in a toner reservoir and are then contacted with screens to create a toner cloud, reference column 3, beginning at line 21, and FIGS. 1 to 4; while U.S. Pat. Nos. 4,330,193 and 4,352,552 illustrate development systems with rolls of magnetized slats which pick up toner from a reservoir to enable the formation of a magnetic brush and U.S. Pat. No. 4,480,905 illustrates a dual roller structure with a single central trimming blade, and more specifically an electronic printing method wherein there is selected a development unit with a plurality of developing rolls, see column 2, beginning at line 33. Also of interest is German Publication No. 2,429,020 directed to a developer wherein there is selected a hopper with a cylinder which contains a stirrer to prevent the toner utilized from settling. Apparently, the toner powder flows through a rotating spout into a u-shaped trough which fits around a ribbed roller, see the Abstract of the Disclosure.

Recently, there has been developed an efficient, economical, simple process and apparatus for the development of latent electrostatic images with single component development systems wherein insulative, nonmagnetic, or color toner particles are appropriately charged and there is obtained two component image quality utilizing a single component development apparatus. In this system, as detailed hereinafter, and as described in U.S. Pat. No. 4,459,009, the disclosure of which is totally incorporated herein by reference, there is selected a charging roll means which simultaneously meters and charges toner particles. A donor electrode serves to transport the toner particles, which electrode can be comprised of numerous suitable materials including, for example, aluminized Mylar overcoated with a polymer containing carbon black.

There is also described in U.S. Pat. No. 4,505,573 a transporting means for insulating toner particles comprised of a suitable substrate and a coating thereover of a low surface energy, wear resistant material. More specifically, there is disclosed in this patent an insulating toner transporting system comprised of a substrate, and a coating of a fluoropolymer. The improved toner transporting means of the patent are particularly useful in an apparatus for charging toner particles comprised in operative relationship of a means for charging insulating toner particles and a means for transporting insulating toner particles, wherein the means for charging the means for transporting insulating toner particles for transporting are biased to a predetermined potential. Accordingly, in one embodiment, the invention of the referred to patent is directed to an apparatus for charging insulating toner particles, which apparatus is comprised in operative relationship of a means for charging insulating toner particles and a means for transporting insulating toner particles, the means for charging and the means for transporting being biased to a predetermined potential wherein the transporting means contains thereover a mixture of a fluoropolymer coating, and conductive particles such as carbon black.

Moreover, illustrated in a copending application U.S. Ser. No. 560,691, is an apparatus for charging insulating toner particles, which apparatus is comprised in operative relationship of a means for charging insulating toner particles, and a means for transporting insulating toner particles, the means for charging and the means for transporting being biased to a predetermined potential; and wherein there is selected, for example, a brush means for transporting the toner particles from a developer sump to the charging nip. The invention of the present application is similar to the apparatus as illustrated in the aforementioned application with the exception that, for example, there is selected for the present invention a squirrel cage for the transportation of the toner particles. While the aforementioned apparatus disclosed is suitable for its intended purposes, there may be disadvantages associated with the utilization of brush fibers inclusive of, for example, fiber weaving; and further, the fibers over a period of time are fractured and undesirably added to the developer material present in the sump, disadvantages overcome by the apparatus of the present invention. Moreover, in some situations with brush systems, particularly with high humidity conditions, that is humidities above 70 percent, there is a tendency for the toner particles to be retained between the brush bristles thereby reducing the efficiency of the toner particles to be delivered to the nip for charging which is not the situation with the apparatus of the present invention.

Although apparatuses similar to those of the present invention are known, there is a need for improved systems. Specifically, for example, there is a need for the transportation of a specific amount of toner particles to a toner transporting means present in some of the aforementioned apparatuses. There is also a need for an improved process and apparatus wherein the toner particles are transported by an assembly of wires, or a squirrel cage. Furthermore, there is a need for the rapid, and consistent collection of toner particles from a developer sump, and the direction of these particles to a charging nip present between a charging means and a toner transporting means. Moreover, there is a need for electrostatographic imaging apparatuses, and methods having incorporated therein the squirrel cage device of the present invention. Additionally, there is a need for apparatuses and processes wherein single component toners can be transported to a charging nip without the undesirable formulation of agglomerates, and wherein the resulting apparatus can be adjusted to enable the utilization of particular toner formulations, including color toners.

SUMMARY OF THE INVENTION

It is therefore an object of the present invention to provide improved imaging apparatuses, and processes.

A further object of the present invention is the provision of an improved imaging apparatus containing therein a charging nip situated between a charging means, and a transporting means; and wherein toner particles are directed to said nip by a squirrel cage device thereby avoiding many of the prior art problems indicated herein.

Additionally, in a further object of the present invention there are provided improved means for collecting, and directing in a controlled manner toner particles to a charging nip present in an imaging apparatus.

Another object of the present invention resides in the provision of a squirrel cage device that will enable the direction of specific amounts of toner particles to a charging nip present in an electrostatic imaging system.

Further, in yet another object of the present invention there are provided imaging and printing methods with the improved apparatus illustrated herein, and containing therein a rotating wire cage, or squirrel cage device that has been biased.

Also, in a further important object of the present invention there are provided single component development systems wherein two component image quality can be obtained.

These and other objects of the present invention are accomplished by the provision of an improved apparatus for charging, and transporting particles, especially nonmagnetic insulating toner particles, which apparatus contains a moving transporting means such as donor electrode roll means, optionally containing thereover a triboelectrically active component; and a charging means which also can function as a metering means, said means being preferably overcoated with a triboelectrically active material, and moving in a direction opposite to the direction of movement of the transporting means; and wherein there is included in the apparatus a biased rotating wire cage, primarily for the purpose of directing toner particles to a charging nip situated between the charging means, and the transporting means, and wherein the wire cage is present in a developer reservoir or sump.

Accordingly, in one embodiment the present invention is directed to an apparatus for a charging insulating toner particles, which apparatus is comprised in operative relationship of a means for charging insulating toner particles, and a means for transporting insulating toner particles, the means for charging and the means for transporting being biased to a predetermined potential; and wherein the apparatus contains therein a biased rotating squirrel cage. In another embodiment of the present invention, there is provided an apparatus for simultaneously metering and charging nonmagnetic insulating toner particles comprising in operative relationship a metering/charging roll means, a triboelectrically active coating contained on the metering/charging roll means, a doctor blade means for the metering/charging roll means, toner supply reservoir means containing therein weakly charged insulating toner particles possessing about an equal number of positive toner particles and negative toner particles, a transporting toner belt means comprised of, for example, a nickel sleeve optionally containing on its entire surface a coating of specific fluoropolymers, acrylic resins, and silicone resins, a voltage source means for the metering/charging roll means, a voltage source means for the nickel sleeve means, the metering/charging roll means moving in a direction opposite to the direction of the movement of the transport donor sleeve means, and wherein the reservoir has present therein a squirrel cage device that collects, and directs a controlled amount of toner particles to a charging nip.

The present invention in another illustrative embodiment is directed to an electrostatographic imaging device comprised of a charging means, an imaging means, a development means, a fixing means, and a fusing means, the improvement residing in the selection of the aforementioned apparatus with a squirrel cage.

BRIEF DESCRIPTION OF THE DRAWINGS

For a better understanding of the present invention and further features thereof, reference is made to the following detailed description of various preferred embodiments wherein.

Figure 1:
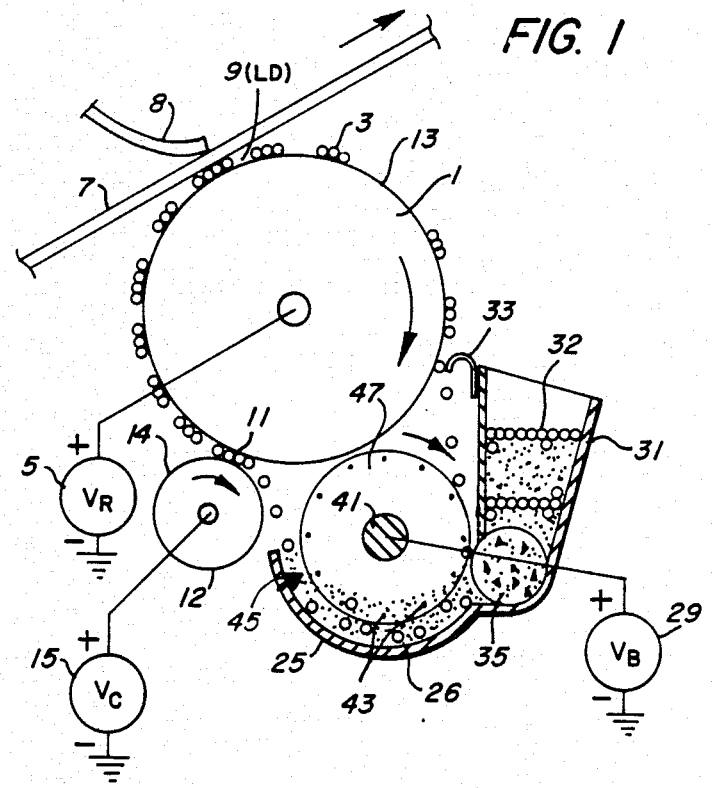
FIG. 1 is a partially schematic cross-sectional view of the apparatus and process of the present invention.
Figure 2:
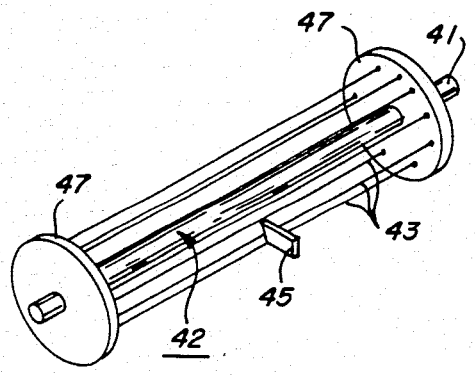
FIG. 2 represents a schematic of the squirrel cage apparatus.

Accordingly, there is illustrated in FIG. 1 a transporting roll means 1 containing a triboelectrically active coating 13 thereon, a metering/charging roll means 12 containing an optional triboelectrically active coating thereon 14, a charging zone 11, a toner supply reservoir means 31 containing therein weakly charged insulating, nonmagnetic toner particles 32 comprised of about an equal number of positively charged toner particles and negatively charged toner particles, a rigid photoreceptor means 7, a pressure blade means 8 present only when a flexible imaging member in place of the rigid member 7 is selected, a voltage source means 5 ($V_R$), a voltage source 15 ($V_C$), an optional voltage source means 29 ($V_B$), which in an alternative embodiment of the present invention may be grounded, a development zone 9 (LD), a toner supply device 25, toner particles 26, a dust seal 33, an optional toner metering roll 35, and present in the toner supply device a biased wire rotating cage, or squirrel cage, reference FIG. 2, comprised of a shaft 41, shaft area 42, wires 43, a pick 45 held by a clamp not shown, which pick deforms the wires enabling said wires to form a harmonic wave thereby permitting vibration thereof, and allowing the toner particles to be removed therefrom, and directed to the charging zone 11; and supporting rings 47 with the rollers being driven in the direction of the arrows by a motor or motors not shown.

In summary, with reference to FIG. 1, the weakly charged insulating toner particles 32 can be deposited on the coating 13 of the transporting roll means 1 as a result of movement of the components, gravitational forces, and the electrostatic force from the voltage source means 5 ($V_R$). More specifically, the toner particles are collected by the squirrel cage and specifically wires 43, and directed to the charging nip subsequent to contact of the wires with pick 45, wherein the toner particles are brought into rubbing contact with the metering/charging roll means 12 in the charging zone 11, thus resulting in, for example, positively charged toner particles 3. The transporting roll means is in tangential contact with roll means 12, and is self-spaced therefrom by insulating toner particles. Positively charged toner particles 3 are then transported on the transporting roll means surface coating 13 until contacting the imaging member 7 in the development zone 9 (LD), wherein the particles are then transferred to the imaging member which has been charged negatively. Pressure blade 8 provides sufficient force to ensure contact of the positively charged toner particles when the imaging member is flexible; however, this blade is not needed for rigid members. Unused positively charged toner particles 3 are, as shown, returned to the toner reservoir 32 for reuse in the system.

The core of metering/charging roll means 12 can be solid or hollow, and can be comprised of numerous known suitable materials including, for example, aluminum, steel, iron, polymeric materials, and the like, providing they are of sufficient strength to be operable in the system. Generally, the core, which is preferably aluminum, is of a radius of from about 0.25 inch to about 2 inches, and preferably is from about 0.5 inch to about 1 inch. The triboelectric coatings can be selected from numerous materials known in the art, including many of the same materials used for coating carrier particles. This coating is selected according to the charge that is desired to be imparted to the toner particles. Thus, if it is desired to impart a positive charge to the toner particles, a coating capable of acquiring negative charges thereon is selected. These coatings include various electronegative polymeric materials such as copolymers of trifluorochloroethylene and vinylchloride commercially available as FPC 461. Examples of other electronegative materials that can be selected include highly halogenated polymers, such as polyvinylidene fluoride, polytetrafluoroethylenes, perfluoroalkoxylated ethylenes, fluorinated ethylenepropylene polytetrafluoroethylene copolymers, polyvinylchlorides, and the like. In those situations where it is desired to impart a negative charge to the insulating toner particles, a coating capable of acquiring a positive charge thereon is selected, including various electropositive materials such as polyvinylpyridines, terpolymers of methacrylates, such as polystyrene/n-butylmethacrylate silane terpolymers, polycaprolactum, and the like. Additionally, there can be selected as coatings materials analogous to thermoplastic toner resins as described hereinafter containing charge control agents for the purpose of imparting a positive or negative charge to the toner particles. Various suitable charge control agents can be used including alkylpyridinium halides, such as cetylpyridinium chloride, quaternary ammonium compounds, or sulfate compounds, hydrozonium compounds, and the like. Generally, the charge enhancing additives are present in an amount of from about 0.1 percent to about 10 percent. The thickness of coating 13 is dependent on many factors including economical considerations, however, this coating is generally of a thickness of from about 2 micrometers to about 125 micrometers, and preferably is of a thickness of from about 2 micrometers to about 75 micrometers.

The transporting donor means can be comprised of numerous suitable materials including, for example, aluminized Mylar overcoated with the fluoropolymer, or a silicone resin; a seamless electroformed nickel belt overcoated with a fluoropolymer; a seamless extruded polymer sleeve overcoated with a polymer containing a conductive additive such as carbon black, which sleeve is overcoated with a fluoropolymer; or a bare electroformed nickel sleeve containing thereover a fluoropolymer coating processed in such a manner to impart a texture to the surface thereof.

The squirrel cage apparatus is known, reference for example *The Wear Properties of Tetrahedrally Bonded Amorphous Thin Films, Thin Film Solids* 140 (1986) p. 222–235, Jansen and Machonkin, the disclosure of which is totally incorporated herein by reference, which cage with wires thereon is selected for the present invention. Generally, the squirrel cage includes a shaft in the form of a tube or a solid member providing it possesses sufficient strength to support the cage in the developer reservoir sump, which shaft may be conductive in situations when a bias is applied thereto, and a wire support consisting of a circular disk that may be conductive or insulative such as an insulative plastic material. There is mounted on the disk tensioned wires, and moreover more than one disk can be selected depending, for example, on the design of the development apparatus provided the objectives of the present invention are achievable. Moreover, the wires connecting the supports may be circular, flat or cross sectional providing these wires will enable a measured amount of toner particles on the surface thereof. The function of the wires is to contact the developer contained in the sump and permit this developer to be slightly agitated on a continuous basis, and wherein subsequently the wires retrieve a measured amount of toner particles and transport these particles to the charging/metering nip. In one alternative embodiment of the present invention, an electrical connection can be accomplished from the conductive support wires out through the center shaft to an electrical pick up component. Moreover, there can be selected a pick for retrieving the toner, which pick is similar to those selected for musical instruments. Another primary function of the pick is to create a harmonic wave in the wire by striking it which in turn permits the toner particles collected on the wire surface to be discarded in the directed of the charging nip. One preferred squirrel cage apparatus is of a length of from 10 to 16 inches long with a diameter of from 1.30 to about 2.0 inches containing from 1 to 2 set parallel picks approximately 5 inches apart with about 50 to 120 wires, and wherein the wire size is from about 3 to about 6 mils round. One particular wire material useful for the present invention is available from Jonathan Steel and Wire, Inc., Worchester, Mass.; however, various chrome/nickel steel components such as piano wire and the like can be selected. Moreover, as wires there may be utilized plastic fibers and combinations of conductive and insulative materials in composite packages that could be selected with or without a bias applied thereto.

Illustrative examples of the image bearing member means 26 and 27, are inorganic and organic photoreceptor materials such as amorphous selenium, selenium alloys, including alloys of selenium-tellurium, selenium arsenic, selenium antimony, selenium-telluriumarsenic, cadmium sulfide, zinc oxide, polyvinylcarbazole, layered organic photoreceptors, such as those containing as an injecting contact carbon dispersed in a polymer overcoated with a photogenerating layer, which in turn is overcoated with a charge transport layer, and an overcoating of an insulating organic resin, such as those members described in U.S. Pat. No. 4,251,612, the disclosure of which is totally incorporated herein by reference. Also, there can be selected as the imaging member a substrate, a transport layer, such as a diamine dispersed in a polymer, and a generating layer such as trigonal selenium, as described in U.S. Pat. No. 4,265,990, the disclosure of which is totally incorporated herein by reference.

Other organic photoreceptor materials include 4-dimethylamino-benzylidene, benzhydrazide; 2-benzylidene-aminocarbazole, 4-dimethylnitro-benzylidene-p-bromo-aniline; 2,4-diphenyl quinazoline; 1,2,4-triazine; 1,5-diphenyl-3-methylpyrazoline 2,4(dimethylamino phenyl)benzoxazole; 3-amino-carbazole; polyvinylcarbazoletrinitrofluorenone charge transfer complexes; phthalocyanines and mixtures thereof, and the like. Generally, positively charged toner compositions are selected when the imaging member is charged negatively as is the situation with most organic photoreceptors, while negatively charged toner particles are selected when the imaging member is charged positively as is the situation with most inorganic photoreceptors such as selenium.

Triboelectric coatings that can be selected for the apparatus of the present invention are as illustrated herein, including the coatings referred to in the appropriate copending applications, and U.S. patents indicated herein, the disclosures of which have been totally incorporated herein by reference. Particularly useful as the coating for the apparatus of the present invention is a material comprised of a mixture of a fluoropolymer and a carbon black, commercially available from available from E. I. duPont deNemours, Inc., which has incorporated therein about 10 percent by weight of silica. Generally, the carbon black which is contained in the fluoropolymer, or added thereto, is present in an amount of from about 0.125 percent by weight to about 10 percent by weight, this carbon black being present primarily for the purpose of increasing the conductivity of the surface of the toner transporting means to about $10^6$ to $10^{10}$ ohm-cm. Moreover, silica and other particulate fillers can also be incorporated into the coatings of the present invention, especially the fluoropolymers, in an amount of from about 3 percent by weight to about 10 percent by weight, for the purpose of creating the desired surface texture. Examples of preferred fillers are Syloid® silicas (Davison Chemical Division of W. R. Grace & Company); amorphous silicas (Illinois Minerals Company); air floated amorphous silicas (Illinois Minerals Company); calcined aluminum silicate (Englehard Minerals & Chemicals Corporation); calcium metasilicates (NYCO); particulate metallic stearates (Witco Chemical Corporation, Mallinckrodt, Inc.); and particulate polymeric resins. The coating can be applied by numerous known methods including, for example, spray coating, dip coating, Myer rod, draw bar, electrostatic deposition, and the like.

Illustrative examples of toner resin materials include for example, polyamides, epoxies, polyurethanes, vinyl resins and polymeric esterification products of a dicarboxylic acid and a diol comprising a diphenol, and diolefins, such as styrene butadienes, especially those available as pliolites. Any suitable vinyl resin may be employed in the toners of the present system, including homopolymers or copolymers of two or more vinyl monomers. Typical vinyl monomeric units are: styrene, p-chlorostyrene vinyl naphthalene, ethylenically unsaturated mono-olefins such as ethylene, propylene, butylene, isobutylene and the like; vinyl esters such as vinyl chloride, vinyl bromide, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate, and the like; acrylonitrile methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof. Also esterification products of a dicarboxylic acid and a diol comprising a diphenol may be used as a preferred resin material for the toner composition of the present invention. These materials are illustrated in U.S. Pat. No. 3,655,374, totally incorporated herein by reference, the diphenol reactant being for the formula as shown in column 4, beginning at line 5, of this patent; and the dicarboxylic acid being of the formula as shown in column 6 of the above patent.

The resin is present in an amount so that the total of all ingredients used in the toner equal about 100 percent, thus when 5 percent by weight of a charge enhancing additive is present and 10 percent by weight of a pigment such as carbon black is present, about 85 percent by weight of resin material is selected. The toner resin particles can vary in diameter, but generally range from about 5 micrometers to about 30 micrometers in diameter, and preferably from about 10 micrometers to about 20 micrometers. Various suitable pigments or dyes may be selected as the colorant for the toner particles, such materials being well known; and including, for example carbon black, nigrosine dye, aniline blue, calco oil blue, chrome yellow, ultramarine blue, duPont oil red, methylene blue chloride, phthalocyanine blue and mixtures thereof. The pigment or dye should be present in sufficient quantity to render the toner highly colored to permit it to form a clearly visible image on the recording member. For example, where conventional xerographic copies of documents are desired the toner may comprise a black pigment such as carbon black or a black dye such as Amaplast black dye available from the National Aniline Products Inc. Preferably, the pigment is employed in amounts of from about 3 percent to about 20 percent by weight, based on the total weight of the toner; however, if the colorant employed is a dye, substantially smaller quantities of the color may be used.

The apparatus and process of the present invention can be selected for utilization in various imaging systems, including those as disclosed in U.S. Pat. Nos. 4,459,009; 4,618,241 and U.S. Ser. No. 560,691.

Although the invention has been described with reference to specific preferred embodiments, it is not intended to be limited thereto, rather those skilled in the art will recognize variations and modifications may be made therein which are within the spirit of the present invention and within the scope of the following claims.

What is claimed is:

1. An improved apparatus for charging toner paticles comprised of a means for charging insulating toner particles, and a means for transporting insulating toner particles, said means for transporting, and said means for charging being charged to a predetermined potential, which apparatus further includes therein a rotating biased wire device for delivering toner particles to a charging nip situated between the means for charging, and the means for transporting the toner particles.

2. An apparatus in accordance with claim 1 wherein the means for charging contains thereover a triboelectric active coating.

3. An apparatus in accordance with claim 2 wherein the triboelectric active coating is electropositively charged.

4. An apparatus in accordance with claim 1 wherein the means for transporting contains thereover a triboelectric active coating.

5. An apparatus in accordance with claim 4 wherein the triboelectric active coating is electropositively charged.

6. An apparatus in accordance with claim 1 wherein the wire device contains a pick thereon.

7. An apparatus in accordance with claim 1 wherein the rotating biased wire device is a squirrel cage.

8. An apparatus in accordance with claim 7 wherein the wire device contains a pick thereon.

9. An apparatus in accordance with claim 7 wherein the imaging means is flexible.

10. An apparatus in accordance with claim 7 wherein the imaging means is rigid.

11. An apparatus in accordance with claim 1 further including therein a means for imaging, and wherein the charged insulating toner particles are deposited thereon in image configuration.

12. An apparatus in accordance with claim 11 wherein the imaging means is comprised of a selenium photoconductor.

13. An apparatus in accordance with claim 11 wherein the imaging means comprises a layered organic photoconductive member comprising a substrate, a charge transport layer, and a charge generating layer.

14. An apparatus for simultaneously metering, charging and transporting nonmagnetic insulating toner particles comprising in operative relationship a metering roll means, a toner supply reservoir means containing therein weakly charged insulating toner particles possessing about an equal number of positive and negative charges thereon, a transporting means, a triboelectrically active coating contained on said transporting means an imaging means, a voltage source means for the metering roll means, a voltage source means for the transporting means, said metering roll means moving in a direction opposite to the direction of movement of the transporting means, and wherein the apparatus further includes a rotating brush wire device contained in the toner supply reservoir which device transports toner particles to a charging nip situated between the metering roll means and the transporting means.

15. An apparatus in accordance with claim 14 wherein a voltage source means is connected to the brush means, and wherein a voltage of from about zero volts to about 300 volts is applied to the rotating brush wire device.

16. An apparatus in accordance with claim 14 wherein the imaging means is a rigid imaging member.

17. An apparatus in accordance with claim 16 wherein the imaging member is selected from the group consisting of amorphous selenium, amorphous selenium alloys, and a layered photoresponsive device comprised of a substrate, a photogenerating layer and a charge transport layer.

18. An apparatus in accordance with claim 14 wherein there is applied to the metering roll means a voltage of from about +25 volts to about +200 volts or from about −25 volts to about −200 volts; there is applied to the drive roll means a voltage of from about +75 volts to about +450 volts, or from about −75 volts to about −450 volts; and there is applied to the wire device a voltage of from about zero volts to about 300 volts.

19. An apparatus in accordance with claim 14 wherein the triboelectrically active coating is comprised of an electronegative material in a thickness of 0.1 mil to about 5 mils.

20. An apparatus in accordance with claim 19 wherein the electronegative material is selected from the group consisting of trifluorochloroethylene and vinylchloride copolymers, polyvinylidene fluorides, polytetrachlorofluoroethylenes, perfluoroalkoxylated ethylenes, polytetrafluoroalkoxy ethylenes, and polyvinylchlorides; and the electropositive material is selected from the group consisting of polyvinylpyridines, terpolymers of methacrylates, and thermoplastic toner resins.

21. An apparatus in accordance with claim 14 wherein the triboelectrically active coating comprises an electropositive material in a thickness of 0.1 mil to about 5 mils.

22. An electrostatic imaging device comprised of a charging means, an imaging means, a development means and a fixing means, the improvement residing in the development means which is comprised of an apparatus for metering and charging nonmagnetic insulating toner particles comprising in operative relationship a moving metering roll means, a transport donor roll means containing thereon a triboelectrically active coating, a toner supply reservoir means containing therein weakly charged toner particles, a voltage source means for the metering roll means, and a voltage source means for the transport donor roll means, wherein toner particles are charged in a zone encompassed by said metering/charging roll means and said transport donor roll means; and wherein the apparatus further includes therein a rotating biased wire brush; and wherein said device conveys toner particles from the toner supply reservoir to the charging nip situated between the rollers.

23. A process for charging toner particles which comprises (1) providing a moving toner transporting means containing a triboelectrically active coating thereon, and moving metering roll means; (2) providing a rotating biased wire device wherein uncharged toner particles supplied to the device are triboelectrically charged; and (3) subsequently causing the charged toner particles to move to a charging zone is situated between the toner transporting means and the metering/charging roll means whereat the toner particles are further triboelectrically charged.

* * * * *